US011446791B2

(12) United States Patent
Marx

(10) Patent No.: US 11,446,791 B2
(45) Date of Patent: Sep. 20, 2022

(54) CLAMPING ASSEMBLY FOR CUTTING MACHINE

(71) Applicant: Michael J. Marx, White Lake, MI (US)

(72) Inventor: Michael J. Marx, White Lake, MI (US)

( * ) Notice: Subject to any disclaimer, the term of this patent is extended or adjusted under 35 U.S.C. 154(b) by 0 days.

(21) Appl. No.: 17/192,483

(22) Filed: Mar. 4, 2021

(65) Prior Publication Data

US 2021/0276155 A1 Sep. 9, 2021

Related U.S. Application Data

(60) Provisional application No. 62/986,866, filed on Mar. 9, 2020.

(51) Int. Cl.
*B25B 5/04* (2006.01)

(52) U.S. Cl.
CPC ..... *B25B 5/04* (2013.01)

(58) Field of Classification Search
CPC ..... B25B 5/04; B25B 5/003; B25B 5/006; B25B 5/12; B25B 5/061; B25B 5/163; B25B 5/125; B25B 1/2482; B25B 1/00; B25B 1/14
See application file for complete search history.

(56) References Cited

U.S. PATENT DOCUMENTS 3,397,879 A * 8/1968 Morawski ..... B25B 5/062 269/91
7,926,394 B1 * 4/2011 Gallagher ..... B23Q 3/06 269/96
8,523,156 B2 * 9/2013 Hou ..... B25B 5/10 269/37
8,827,255 B2 * 9/2014 Woods ..... B25B 5/12 269/285
2010/0327134 A1 * 12/2010 Lundrigan ..... F16M 13/02 248/220.31
2019/0152022 A1 * 5/2019 Hsu ..... B25B 5/04
2019/0337126 A1 * 11/2019 Lin ..... B25B 27/02

* cited by examiner

*Primary Examiner* — Anne M Kozak
*Assistant Examiner* — Bobby Lee Budziszek
(74) *Attorney, Agent, or Firm* — Harness, Dickey & Pierce, P.L.C.

(57) ABSTRACT

A clamp assembly for securing a workpiece to a cutting machine having a plurality of slats is set forth. The slats have a depth and a space between the plurality of slats have a width. A base has a first surface and a second surface opposite the first surface. An elongated extension has a first end coupled to the base and a second end having a flange wider than the width. A clamping mechanism is coupled to the base. The clamping mechanism has a compliant stopper movable from a clamping position and an open position.

19 Claims, 6 Drawing Sheets

CLAMPING ASSEMBLY FOR CUTTING MACHINE

CROSS-REFERENCE TO RELATED APPLICATION

The present disclosure claims the benefit of provisional application 62/986,866 filed on Mar. 9, 2020, the disclosure of which is incorporated by reference herein.

FIELD

The present disclosure relates to a clamping assembly and, more specifically, to a clamping assembly for use with a cutting machine.

BACKGROUND

This section provides background information related to the present disclosure and is not necessarily prior art.

Cutting machines use a water or coolant bath that has a plurality of spaced apart slats that extend thereacross. The slats are disposed vertically and are spaced apart. Securing a workpiece to be cut is important. If movement occurs, an improper cut may occur causing the workpiece to be scrapped. Clamping systems are used to prevent movement. Prior known systems employ expensive clamping systems that require plunging the operator's hands into the coolant to secure and to make adjustments.

SUMMARY

This section provides a general summary of the disclosure, and is not a comprehensive disclosure of its full scope or all of its features.

The present system allows various types of clamping assemblies to be used to hold the material during the cutting process. The clamping assemblies are easier to be placed and may be easily locatable without the operator reaching into the coolant.

In one aspect of the disclosure, a clamp assembly for securing a workpiece to a cutting machine has a plurality of slats. The slats have a depth and a space between the plurality of slats having a width. A base has a first surface and a second surface opposite the first surface. An elongated extension has a first end coupled to the base and a second end having a flange wider than the width. A clamping mechanism is coupled to the base. The clamping mechanism has a compliant stopper movable from a clamping position and an open position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Example embodiments will now be described more fully with reference to the accompanying drawings.

Figure 1:
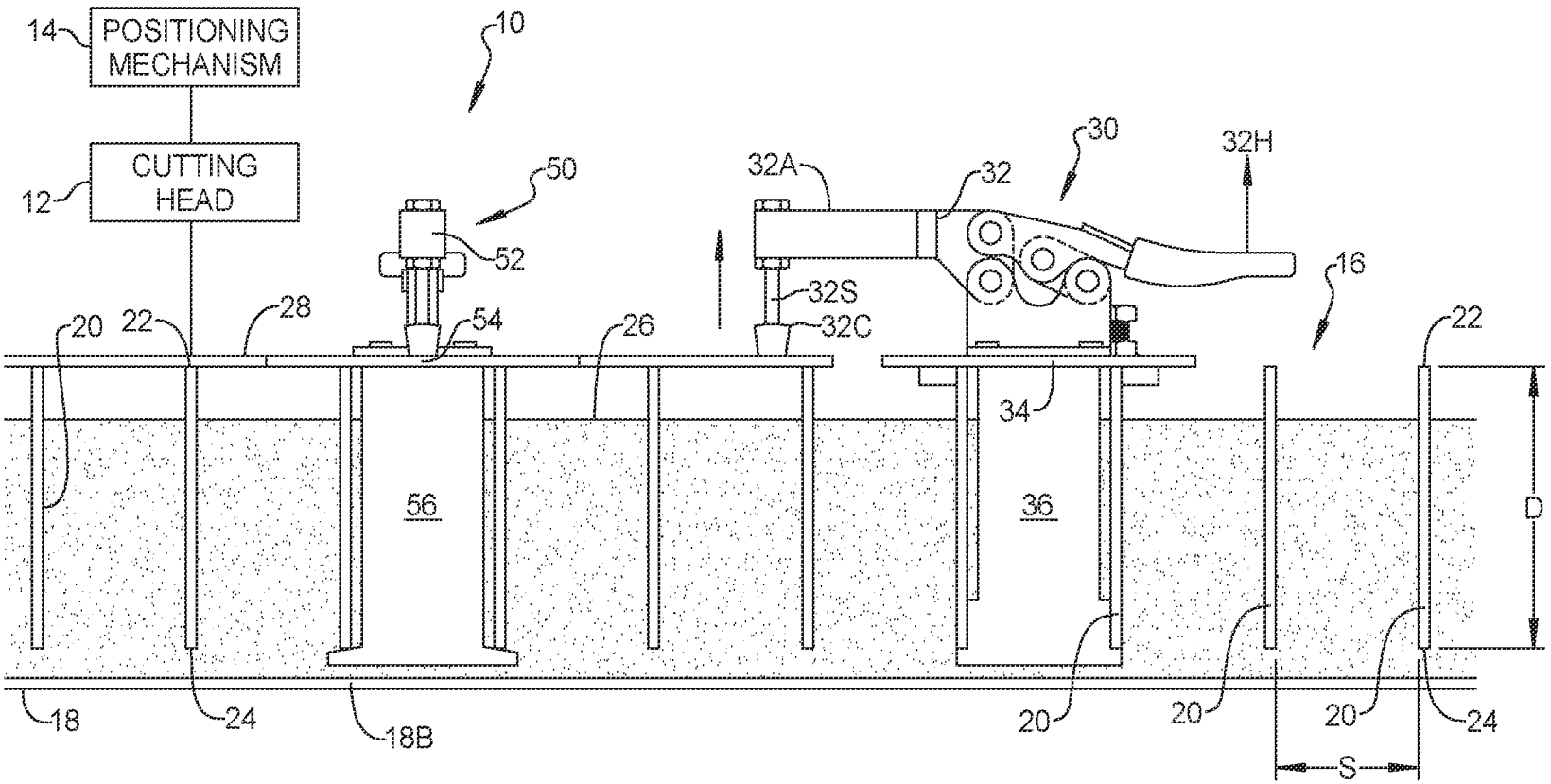
FIG. 1 is a view of an end clamping assembly and a side clamping assembly disposed of a cutting machine holding a workpiece.

Referring now to FIG. 1, a cutting machine 10 has a cutting head 12 and a positioning mechanism 14 that positions the cutting head 12 relative to a work surface 16 of a coolant table 18. The cutting head 12 may be but not limited to plasma, laser or water jet technology. The work surface 16 of the coolant table 18 is defined by a plurality of slats 20. The slats 20 are elongated and extend across the coolant table 18 usually in a lateral direction. In FIG. 1, the end view of the slats 20 are illustrated.

The slats 20 are disposed vertically and have an upper edge 22 and a lower edge 24. The upper edge 22 are disposed above a coolant level 26 of the coolant table 18. The lower edge 24 is disposed spaced apart from and above a bottom surface 18B of the coolant table 18. Many cutting machine tables employ slats 20 that are spaced a spacing distance S of about 1¾ inches apart, in this example. The distance D between the upper edge 22 and the lower edge of the slats 20 is referred to as the depth of the slats 20.

End clamping assemblies 30 (one of which is shown) and side clamping assemblies 50 (one of which is shown) may be used to hold a workpiece 28 or piece of material to be cut. As illustrated in FIG. 1, the clamping assemblies 30, 50 are clamped to the underside of the slats and horizontal clamping mechanisms 32, 52, respectively are used together with a respective base 34, 54 and a respective extension 36, 56 to secure the workpiece 28 or material to be cut. Although a toggle clamp is illustrated as the clamping mechanisms, different types of clamping mechanisms may be used. In this example 32H is in a downward position as illustrated if FIG. 1, the arm 32A, the spindle 32S and the compliant stopper 32C are locked into place. The spindle 32S may have threads and may be rotated to move the compliant stopper 32C closer to the arm 32A or further from the arm 32A to adjust for the thickness of the workpiece 28. To move the workpiece, the handle 32H is moved away from the coolant table 18.

In a commercial setting, depending upon the size of the table and the requirements, one or more end clamping assemblies 30 and one or more side clamping assemblies 50 may be provided to a customer as a set. Various numbers of end clamping assemblies 30 and side clamping assemblies 50 may be disposed at various locations around the material to be cut depending on the size. The clamping assemblies 30, 50 have a height that allows the cutting head to move over top thereof.

Figure 2:
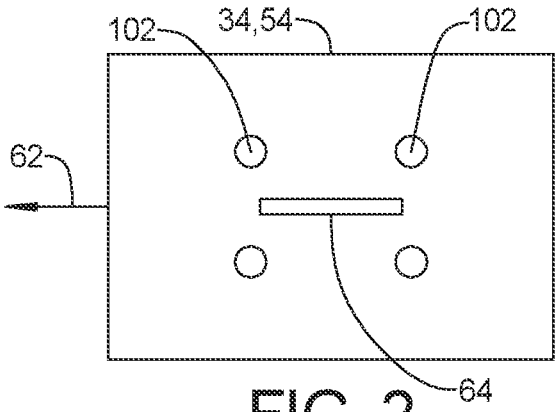
FIG. 2 is a top view of a base of a clamping assembly.

Referring now also to FIG. 2, the clamping assemblies include the base 34, 54 onto which the toggle clamping mechanisms 32, 52 may be coupled through the openings 102 with a fastener (not shown). The fasteners may be rivets or bolts, for example. The base 34, 54 are, in this example, rectangular and therefore have a longitudinal direction 62 that when used for clamping are greater than the spacing S between the slats 20. The base 34, 54 includes a slot 64.

Figure 3:
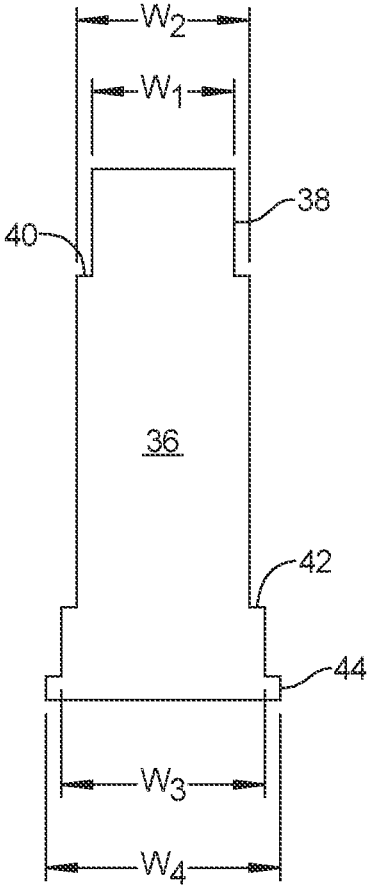
FIG. 3 is a side view of a first example of an elongated extension.
Figure 4:
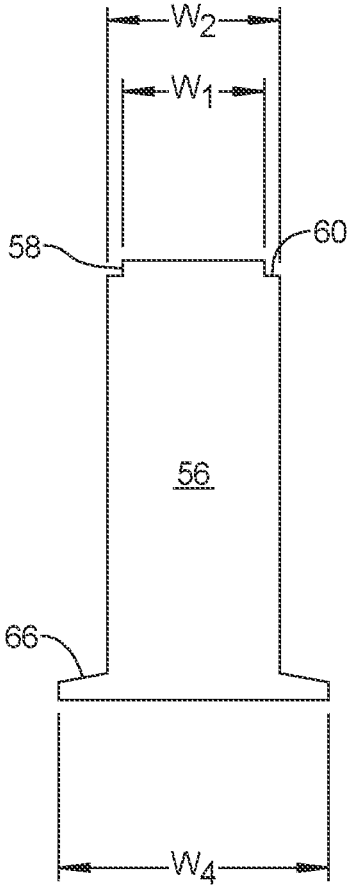
FIG. 4 is a side view of a second example of an elongated extension.

Referring now also to FIGS. 3 and 4, the unassembled extensions 36, 56 are shown in two different examples. However, each may be used for a side clamp or and end clamp. The slot 64 of the base 34, 54 has a length and width to receive a respective extension tab 38, 58. The extension tabs 38, 58 extends up into the slot 64. The extension tab 38 extends through the slot 64, while tab 58 is fully received within the slot 64. Welding way be used to secure the tabs 38, 58 into the slot 64. The tab 38 extends out of the slot 64 and may be used to secure or partially secure the toggle clamping mechanism 32, 52 thereto. The tabs 38, 58 in this example have a width W1 less than the width of the slot 64 so that shoulders 40, 60 are formed onto which the under or lower side of the base 34, 54 rests.

The extension 36 includes a spacer portion 42 that has a width W3 wider than the main body W2. The width W3 corresponds to the space S between the slats 20. The extensions 36, 56 each include an under slat flange 44, 66. The under slat flanges 44, 66 have a width W4 that is wider than the entire space S between the slats and including the thickness of the slats 20. In one constructed example, the under slat flanges 44, 66 have a total width of two inches which is more than enough to extend under the slats 20 which, in the example, are 1.75 inches apart. The width W2 of the remainder of the extension is 1¼ inches wide, in this example, so that when slag interferes with and collects on the top of the slats, the extension easily fits and is accommodated within the space between the slats. The distance between an upper surface 44A of the flange 44 and the underside of the base 34 is approximately D or slightly larger to accommodate slag that could build up on the slats during the cutting process, Referring now to FIGS. 5A-5D, various elevational views of the assembled end clamping assembly 30 is illustrated with the clamping mechanism 32 coupled by two fasteners 70, such as rivets to the tab 38 of the extension 36. A pin lock mechanism 72 is coupled to a top surface of the base 34.

Guides 74 may also be provided on the end clamping assembly 30. In this example, the guides 74 are rectangular and extend longitudinally downward relative to the extension. However, other shapes may be used. The guides 74 are spaced to engage the slats 20. In this example, the guides 74 are on opposite corners of the base. Of course, three corners or all four corners could comprise guides 74. The guides 74 together with the pin lock mechanism 72 help prevent a rotation of the end clamping assembly 30 out of place relative to the space between the slats 20 during use.

Figure 5B:
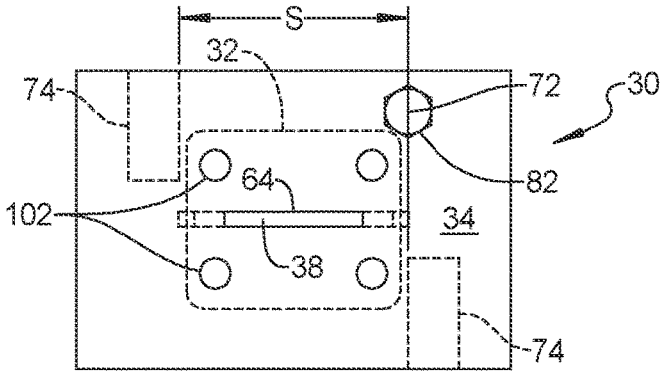
FIG. 5B is a top view of the end clamping assembly of FIG. 5A.
Figure 5A:
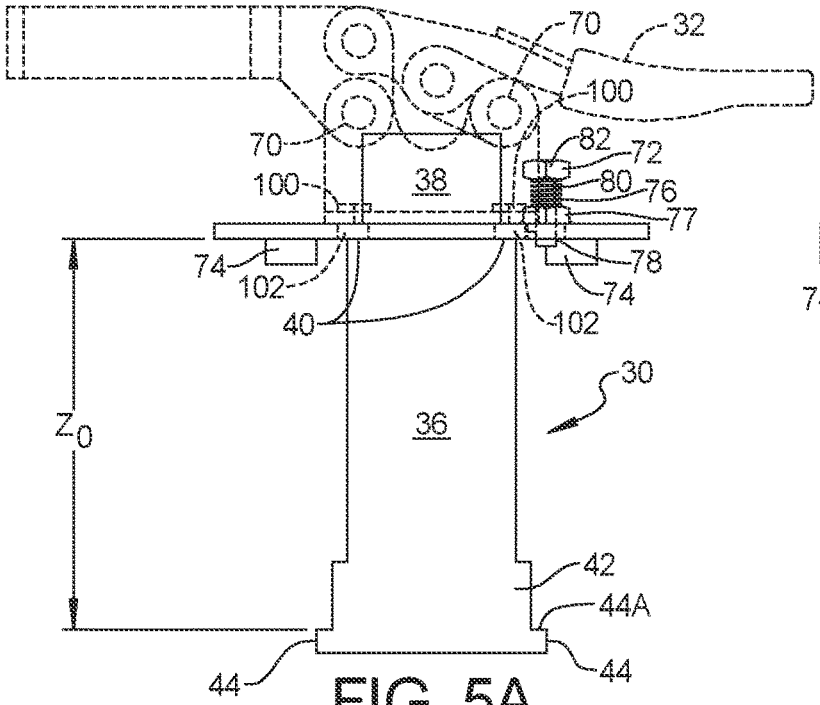
FIG. 5A is a side view of an end clamping assembly.
Figure 5D:
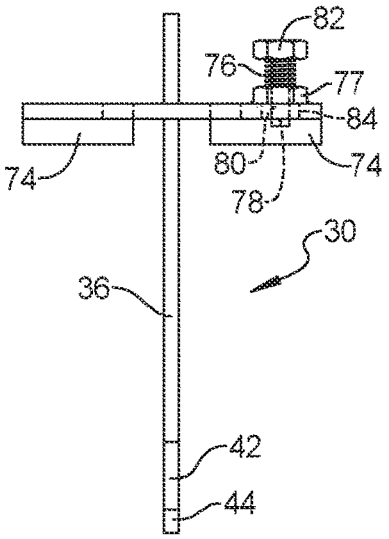
FIG. 5D is a right side view of the end clamping assembly of FIG. 5A.
Figure 5C:
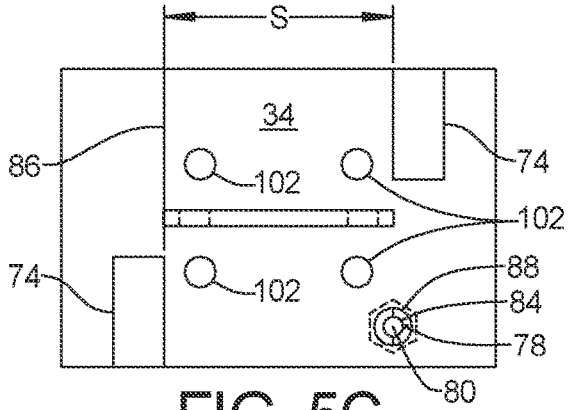
FIG. 5C is a bottom view of the end clamping assembly of FIG. 5A.
Figure 5E:
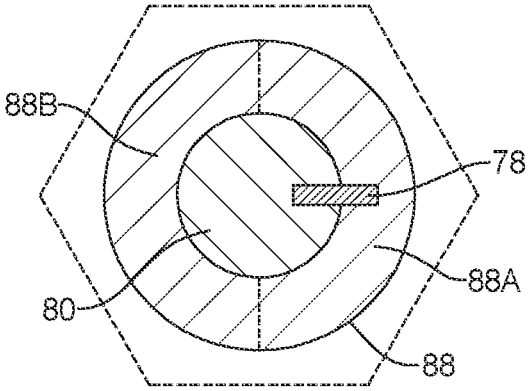
FIG. 5E is an enlarged bottom view of the pin lock mechanism of FIGS. 5A-5D.
Figure 5F:
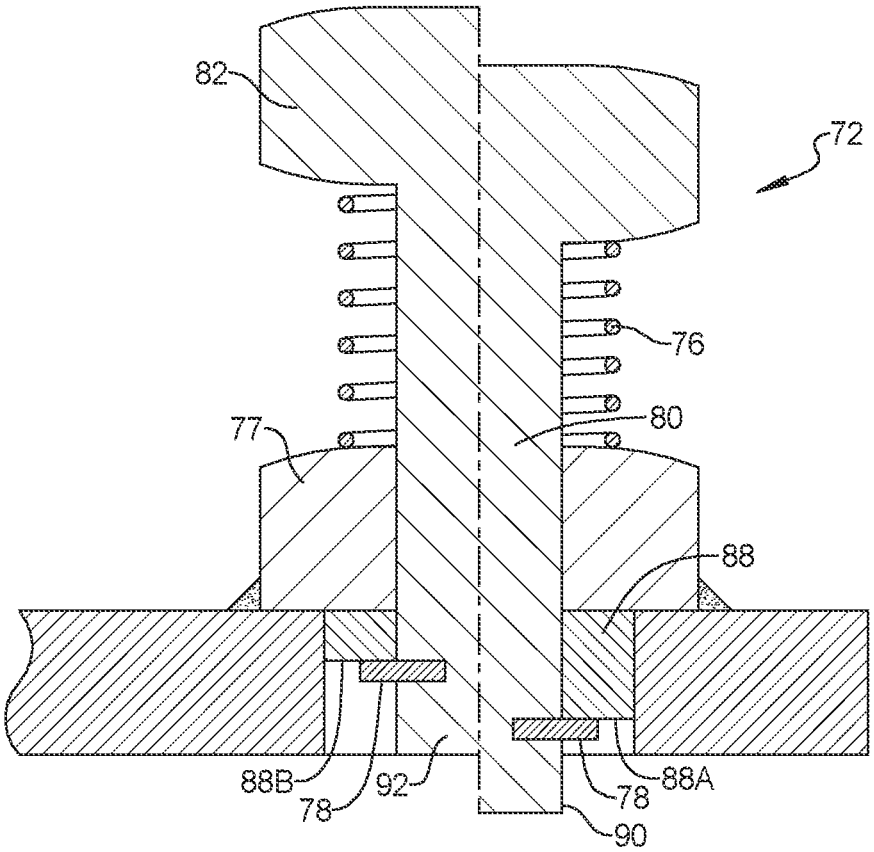
FIG. 5F is a partial cross-sectional view of the pin lock mechanism.
Figure 5G:
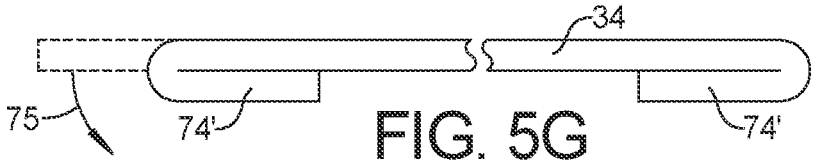
FIG. 5G is a partial side view of alternate configuration for forming a guide.

In the alternative, as shown in FIG. 5G, the guides 74' may be integrally formed of the material of the base 34, 54 and bent around into place as represented by the arrow 75.

The pin lock mechanism 72 may be depressed or released and extends downward against the slats 20 to prevent rotation of the end clamping assembly 30. As will be illustrated further below, the side clamping assembly 50 may not require the guides 74 or the pin lock mechanism 72. The pin lock mechanism 72 has a spring 76, a housing 77 and a head 82 that are disposed on one side of the base 34 and a pin 78 disposed on a shaft 80 on opposite side of the base 34. The pin 78 prevents the shaft 80 of the pin lock mechanism 72 from coming out of the top side of the clamping assembly 30. The head 82 prevents the pin mechanism 72 from moving from the top side of the base 34. The shaft 80 is received in a hole 84 through the base 34. The shaft 80 is disposed from the head 82 to the pin 78. The housing 77 may be affixed to the upper surface of the base 34 such as by welding. The shaft 80 is sized to move freely in the sleeve 88.

In this example, the distance between the guides 74 as illustrated in FIG. 5B is 1.75 inches and therefore corresponds to the width S between the slats. The shaft 80 of the pin lock mechanism 72 has a tangent line 86 that is also 1.75 inches from the guide 74 on the left as illustrated in FIG. 5A-C. The pin lock mechanism 72 prevents rotating or pivoting of the end clamping assembly 30 during operation when deployed in a clamped or handle downward position.

In FIGS. 5C, 5E and 5F, the bottom of the base 34 is illustrated in further detail. The shaft 80 is disposed in a sleeve 88 have more than one bottom sleeve surface 88A and 88B. This allows the pin 78 to position the end of the shaft 80 at position 90 or 92 depending where the pin is aligned. To move the shaft 80 and the pin 78 to the desired position, the head 82 may be rotated. As illustrated, the shaft 80 is outward at 90 when the pin 78 rests against the sleeve surface 88*a* of the sleeve 88. The end of the shaft 80 is flush or nearly flush with the surface of the base when the pin rests against the sleeve surface 88B.

Fasteners 100 may be used for securing the toggle clamping mechanism 32 to the base 34. Openings 102 receive the fasteners 100 therein. Welding may be used in addition to or instead of fasteners 100.

Figure 5H:
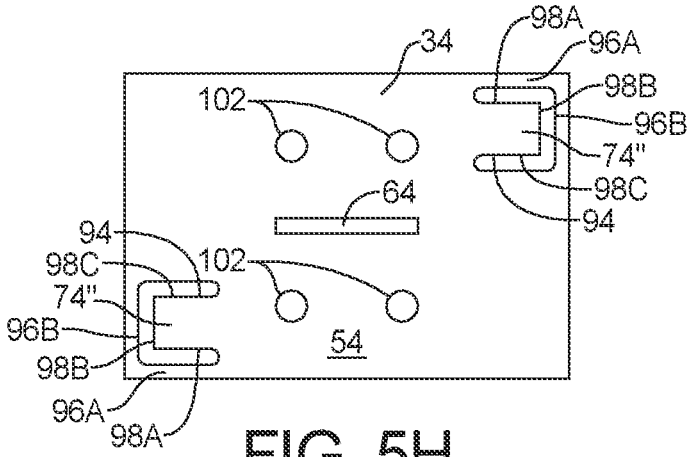
FIG. 5H is a top view of a base having an alternate guide configuration with cutouts.
Figure 5I:
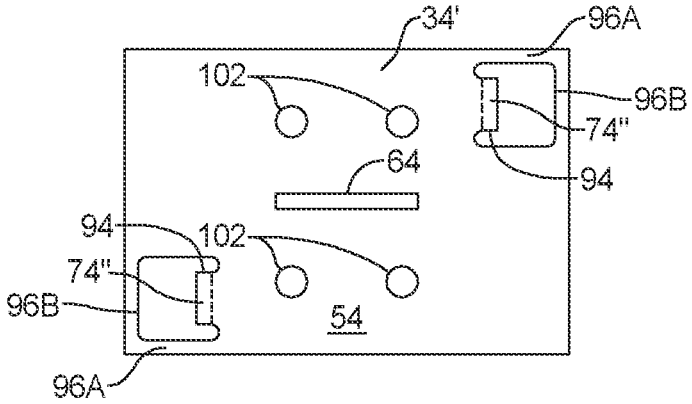
FIG. 5I is a top view of the base of FIG. 5H with the cutouts folded into guides.
Figure 5J:
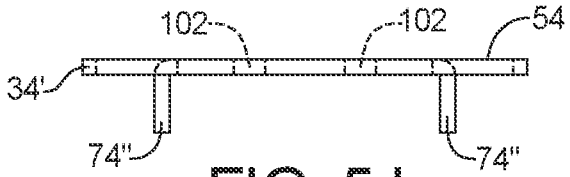
FIG. 5J is a side view of the base of FIG. 5I having the base with the guides folded.

Referring now to FIGS. 5H, 5I, and FIG. 5J, a top view of a base 34' is illustrated comprising a U-shaped channel 94 that is cutout through the thickness of the base 34'. The cutout defines three channel portions that form the U-shaped channel 94. The U-shaped channel 94 is around what becomes the guide 74" which when folded as illustrated in FIG. 5J, is disposed in relatively the same position as the guides 74 and 74' to prevent movement during processing. In this example, two guides 74" are integrally formed into the base 34' and have three sides 98A, 98B, 98C. One or more guides 74" may be used. Because of the integral formation 98D, the guide 74" and may be inexpensively formed, as well. Longitudinal edge 96A and lateral edges 96B are disposed around the cutout channel 94 to form a finished clean surface. The guide 74" extend generally normal or perpendicular to the plane of the base 34'.

Figure 6B:
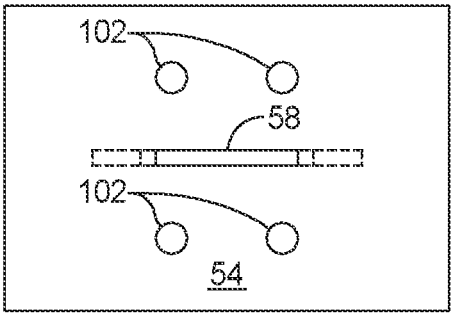
FIG. 6B is a top view of the side clamping assembly of FIG. 6A.
Figure 6A:
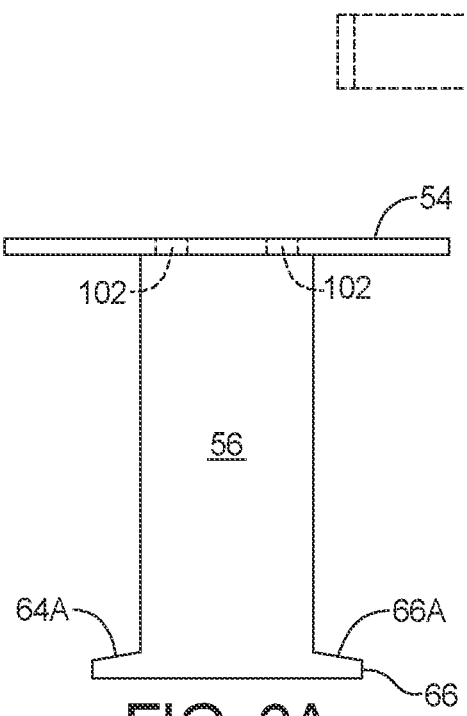
FIG. 6A is a side view of a side clamping assembly.
Figure 6D:
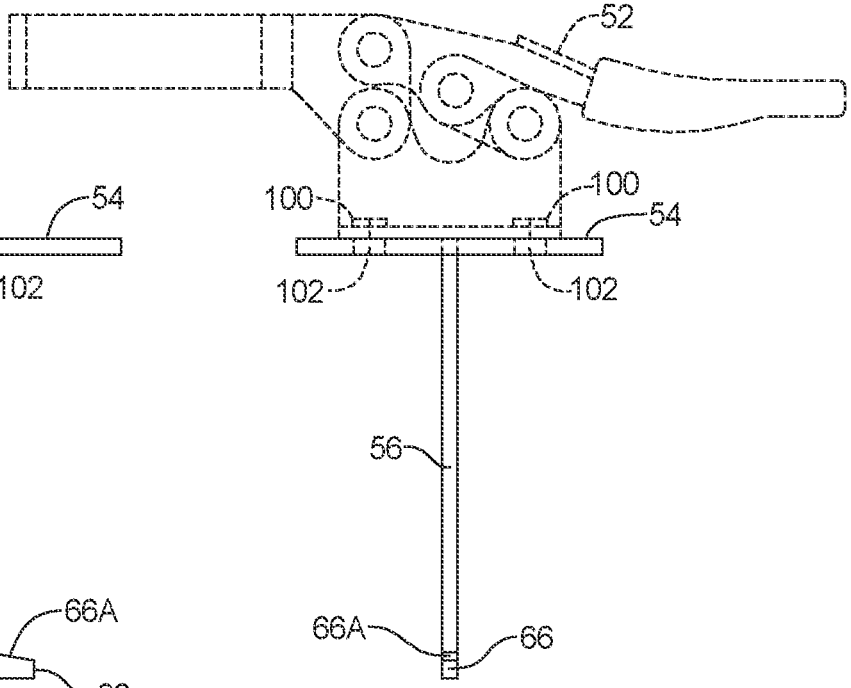
FIG. 6D is a right side view of the side clamping assembly of FIG. 6A.
Figure 6C:
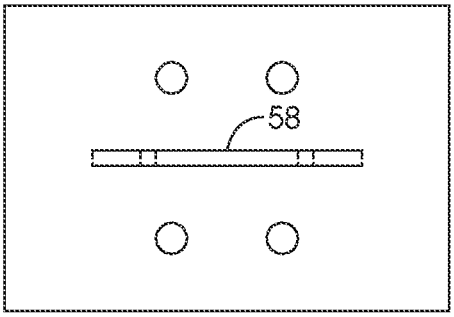
FIG. 6C is a bottom view of the side clamping assembly of FIG. 6A.

FIGS. 6A-6B show the side clamping assembly 50. The side clamping assembly 50 has the toggle clamping mechanism 52 perpendicular to the direction of the extension 56 and the longitudinal direction of the base 34. In the end clamping assembly 30, the extension 36 and the toggle clamping mechanism 32 are disposed in the same direction or are parallel. In this example, fasteners 100, received in openings 102 as illustrated above, may be used to mount the clamping assembly 50 to the base 54. The extension 56 may have a spacer portion like the above example or no spacer portion as set forth in in FIG. 6A. Under-slat flanges 66 as described above may be used. However, in this example the underslat flanges 66 have top surfaces 66A that are angular. The clamping mechanism is a lock and release mechanism as was described above.

The extension tab 58, in this example, does not extend above the base 54. The base 54 and the clamping mechanism 52 are coupled together and the extension 56 may be welded or otherwise mounted or affixed at the tab 58 to the base 54 without extending through the base 54. It should be noted that a small portion of the extension may extend up into the space between the legs of the clamping mechanism.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A clamp assembly for securing a workpiece to a cutting machine having a plurality of vertically disposed slats having a depth and a space between the plurality of slats comprising a first width, each of the plurality of slats comprising an upper edge and a lower edge, said clamp assembly comprising: a planar base comprises an upper surface and a lower surface opposite the upper surface, said planar base comprising at least one of a base length and a base width greater than the first width; an elongated extension comprising a first end coupled to the planar base and extending perpendicularly from the lower surface toward the lower edge between adjacent slats of the plurality of slats, said extension having a second width less than the first width and said elongated extension comprising a second end comprising a flange having a third width greater that the first and second width, said flange engaging lower edges of the adjacent slats of the plurality of slats, said elongated extension comprising a thickness, said base length greater than the thickness; and a clamping mechanism coupled to the upper surface of the planar base, wherein the clamping mechanism is coupled to the upper surface by means of a plurality of openings on the upper surface of the planar base, said clamping mechanism comprising a compliant stopper movable from a clamping position and an open position.

2. The clamp assembly as recited in claim 1 wherein the base is rectangular.

3. The clamp assembly as recited in claim 1 wherein a distance between the flange and the planar base is about the depth.

4. The clamp assembly as recited in claim 1 wherein the clamping mechanism is disposed at the upper surface, and further comprising a first guide and a second guide extending from the lower surface, wherein the first guide and the second guide are spaced apart and disposed on opposite corners.

5. The clamp assembly as recited in claim 4 further comprising a pin lock mechanism coupled to the planar base adjacent in a corner without the first guide or the second guide.

6. The clamp assembly as recited in claim 5 wherein the pin lock mechanism comprises a shaft extending through an opening in the planar base, a pin disposed on a first side of the shaft and a spring and a head disposed on an opposite side of the base.

7. The clamp assembly as recited in claim 1 wherein the clamping mechanism extends laterally across the planar base.

8. The clamp assembly as recited in claim 1 wherein the clamping mechanism extends longitudinally across the planar base.

9. The clamp assembly as recited in claim 1 wherein the elongated extension is disposed longitudinally relative to the planar base.

10. The clamp assembly as recited in claim 1 wherein the clamping mechanism comprises a toggle clamp.

11. A clamp assembly for securing a workpiece to a cutting machine having a plurality of vertically disposed slats having a depth and a space between the plurality of slats comprising a first width, each of the plurality of slats comprising an upper edge and a lower edge, said clamp assembly comprising: a base comprises an upper surface and a lower surface opposite the upper surface; an elongated extension comprising a first end coupled to the base and extending from the lower surface toward the lower edge between adjacent slats of the plurality of slats, said first end comprising a tab, said elongated extension having a second width less than the first width and said elongated extension comprising a second end comprising a flange having a third width greater that the first and second width, said flange engaging lower edges of the adjacent slats of the plurality of slats; and a clamping mechanism coupled to the base, said clamping mechanism comprising a compliant stopper movable from a clamping position and an open position.

12. The clamp assembly as recited in claim 11 wherein the base has a first dimension greater than the width between the plurality of slats.

13. The clamp assembly as recited in claim 5 wherein the first guide and the second guide are integrally formed with the planar base.

14. The clamp assembly as recited in claim 13 wherein the first guide and the second guide are formed by a U-shaped channel in the planar base.

15. The clamp assembly as recited in claim 11 wherein the tab extends through a slot in the base.

16. The clamp assembly as recited in claim 11 wherein the clamping mechanism is coupled to the tab.

17. The clamp assembly as recited in claim 11 wherein the clamping mechanism is coupled to the tab and the base.

18. The clamp assembly as recited in claim 11 wherein the tab is fully received in a slot and wherein the clamping mechanism is coupled to the base.

19. A clamp assembly for securing a workpiece to a cutting machine having a plurality of vertically disposed slats having a depth and a space between the plurality of slats comprising a first width, each of the plurality of slats comprising an upper edge and a lower edge, said clamp assembly comprising:

a base comprises an upper surface and a lower surface opposite the upper surface;

an elongated extension comprising a first end coupled to the base and extending from the lower surface toward the lower edge between adjacent slats of the plurality of slats, said extension having a second width less than the first width and said elongated extension comprising a second end comprising a flange having a third width greater that the first and second width, said flange engaging lower edges of the adjacent slats of the plurality of slats; and a clamping mechanism coupled to the base, said clamping mechanism comprising a compliant stopper movable from a clamping position and an open position, wherein the clamping mechanism is disposed at the upper surface;

a first guide and a second guide extending from the lower surface, wherein the first guide and the second guide are spaced apart and disposed on opposite corners;

a pin lock mechanism coupled to the base adjacent in a corner without the first guide or the second guide, said the pin lock mechanism comprises a shaft extending through an opening in the base, a pin disposed on a first side of the shaft and a spring and a head disposed on an opposite side of the base;

wherein the shaft is disposed in a sleeve having a first sleeve surface uneven with a second sleeve surface, wherein either the first sleeve surface or the second sleeve surface engage the pin.

* * * * *